United States Patent [19]

Jackson et al.

[11] 4,368,712

[45] Jan. 18, 1983

[54] VAPOROUS GASOLINE FUEL SYSTEM AND CONTROL THEREFOR

[75] Inventors: Kenneth A. Jackson, Wooster; George I. Arndt, Loudonville; James L. Maynard, Cuyahoga Falls, all of Ohio

[73] Assignee: V.G.A.S., Inc., Loudonville, Ohio

[21] Appl. No.: 173,605

[22] Filed: Aug. 1, 1980

[51] Int. Cl.[3] ..... F02M 17/18; F02M 17/22

[52] U.S. Cl. ..... 123/523; 123/522; 123/440; 261/36 A; 261/104

[58] Field of Search ..... 123/522, 523, 524; 261/36 A, 119 R, 79 R, 102, 104

[56] References Cited

U.S. PATENT DOCUMENTS

| | | | |
|---|---|---|---|
| 983,646 | 2/1911 | Roberts et al. . | |
| 1,278,946 | 9/1918 | Langworthy | 123/522 |
| 1,403,848 | 1/1922 | Forrest | 123/522 |
| 1,470,204 | 10/1923 | Swartz . | |
| 1,828,134 | 10/1931 | Fahrney | 261/36 A |
| 2,400,821 | 5/1946 | Goode | 261/36 A |
| 3,325,152 | 6/1967 | Wahnish | 261/119 R |
| 3,338,223 | 8/1967 | Williams . | |
| 3,749,376 | 7/1973 | Alm et al. . | |
| 3,790,139 | 2/1974 | Stephensen . | |
| 3,854,463 | 12/1974 | Burden . | |
| 3,999,526 | 12/1976 | Asfar . | |
| 4,074,666 | 2/1978 | Pierce | 261/119 R |
| 4,076,002 | 2/1978 | Mellqvist . | |
| 4,138,979 | 2/1979 | Taplin | 123/489 |
| 4,153,021 | 5/1979 | Hattori | 123/440 |
| 4,177,779 | 12/1979 | Ogle . | |
| 4,196,710 | 4/1980 | Lehar | 123/523 |
| 4,200,064 | 4/1980 | Engele . | |
| 4,204,485 | 5/1980 | Perepolkin . | |

*Primary Examiner*—Ronald H. Lazarus

*Attorney, Agent, or Firm*—Baldwin, Egan, Walling & Fetzer

[57] ABSTRACT

A fuel system and electronic control therefor which is especially designed for use with an internal combustion engine or the like in which said fuel system is operable to provide fuel fumes or vapor to the engine from a source of liquid ignitable vaporizable fuel, such as gasoline, of sufficient quantity whereby to significantly increase the efficiency of the engine and thus substantially increase the per gallon mileage rate for the engine when used in an automotive vehicle or the like, and one using liquid fuel as the original fuel source. The system incorporates an electronic control operable to monitor the combustion of the vaporizable fuel and which control is responsive to a change in engine demand for said fuel to maintain the optimum ratio of vaporized fuel and air in the mixture delivered to the engine for combustion.

18 Claims, 18 Drawing Figures

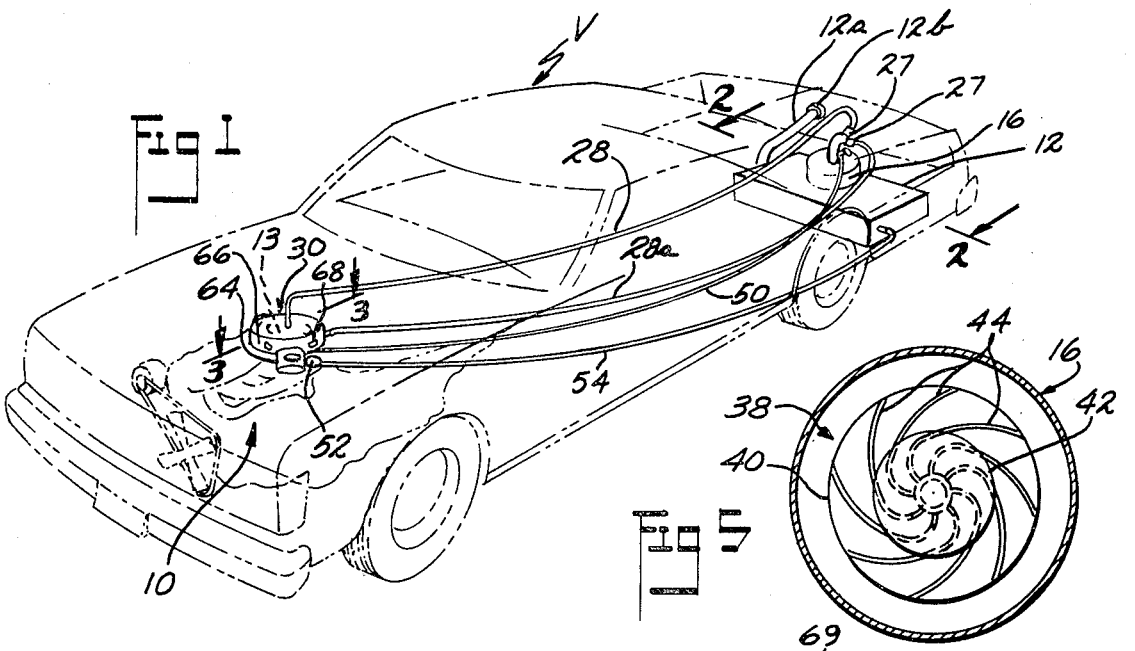
Fig 1
Fig 5
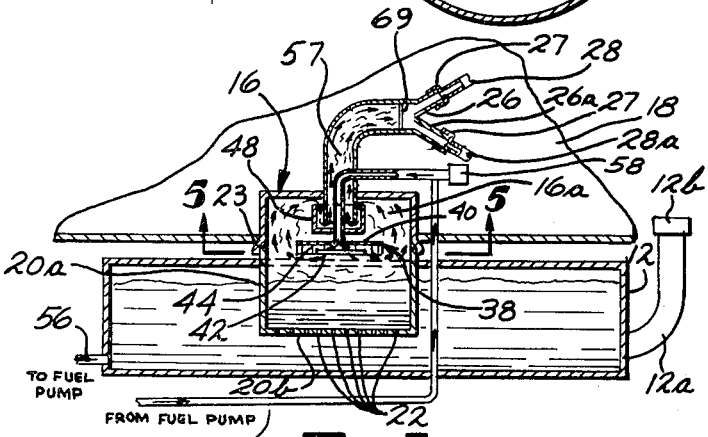
Fig 2
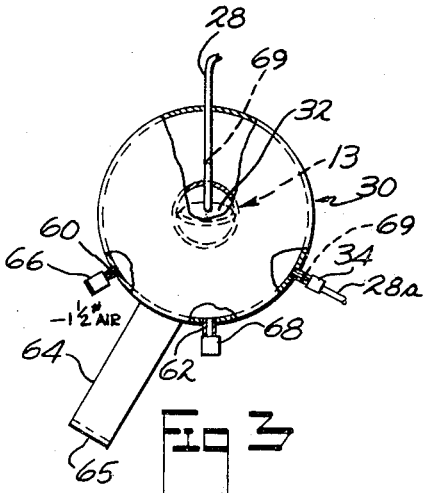
Fig 3
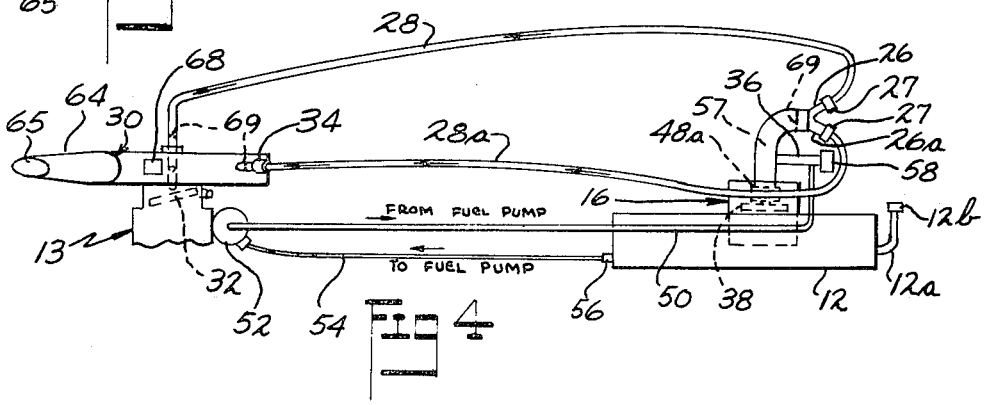
Fig 4

Fig 11
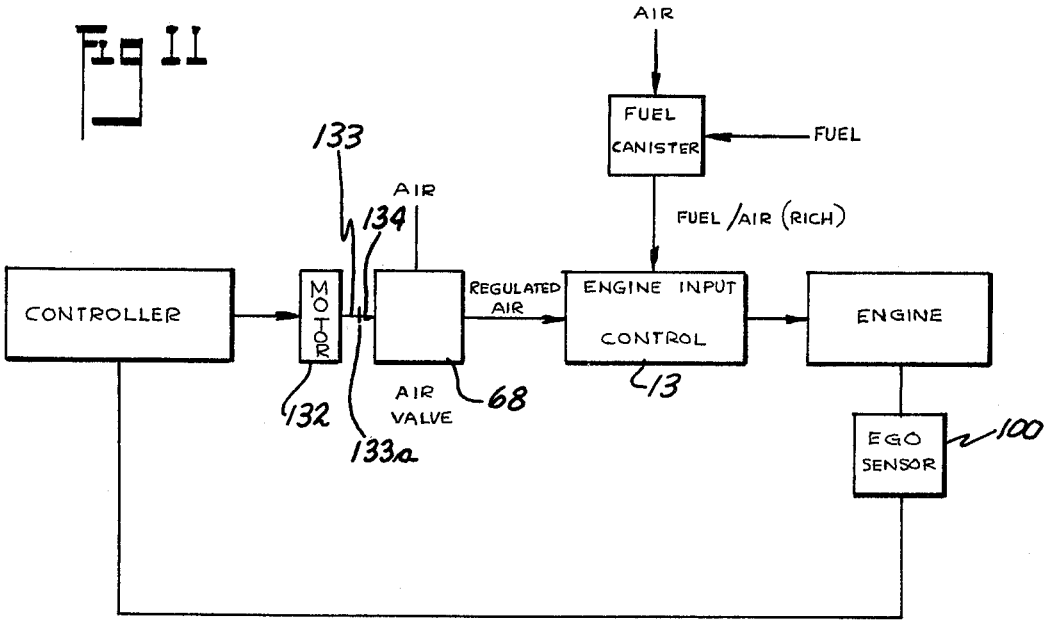
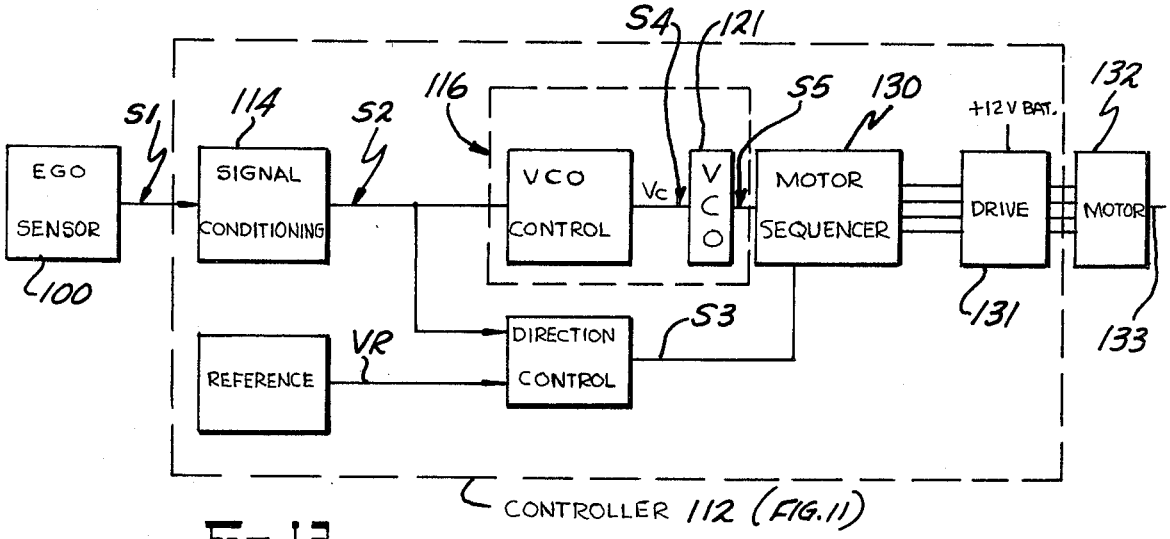
Fig 12

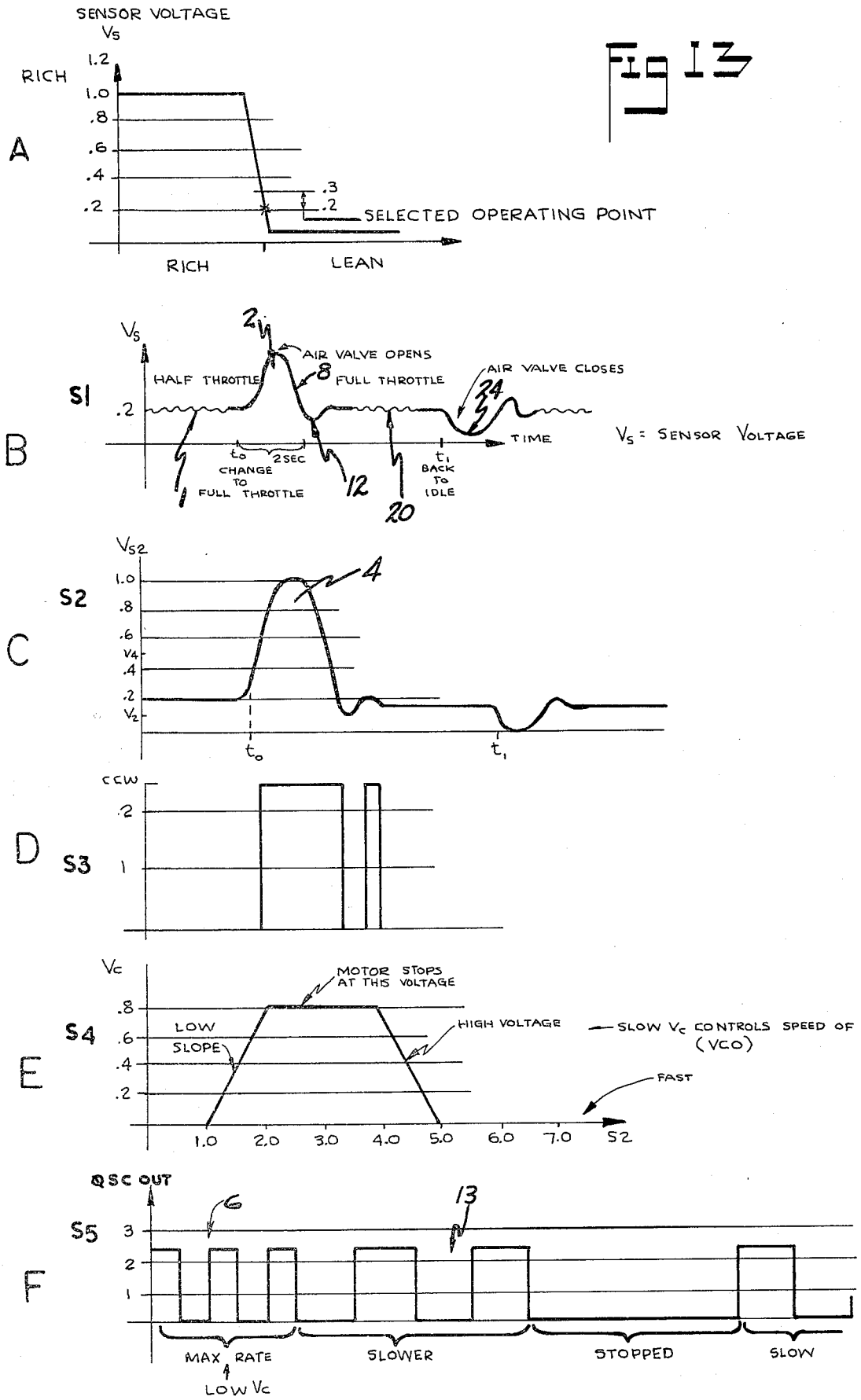
Fig 13
SENSOR VOLTAGE
$V_S$
RICH
1.2
1.0
.8
.6
.4
.2
.3
.2
SELECTED OPERATING POINT
RICH
LEAN
A
$V_S$
S1
.2
HALF THROTTLE
AIR VALVE OPENS
FULL THROTTLE
AIR VALVE CLOSES
TIME
$V_S$ = SENSOR VOLTAGE
$t_0$
2 SEC
CHANGE TO FULL THROTTLE
$t_1$
BACK TO IDLE
2
8
12
20
24
B
$V_{S2}$
S2
1.0
.8
.6
$V_4$
.4
.2
$V_2$
4
$t_0$
$t_1$
C
CCW
.2
S3
1
D
$V_C$
S4
.8
.6
.4
.2
MOTOR STOPS AT THIS VOLTAGE
LOW SLOPE
HIGH VOLTAGE
SLOW $V_C$ CONTROLS SPEED OF (VCO)
FAST
1.0
2.0
3.0
4.0
5.0
6.0
7.0
S2
E
QSC OUT
S5
3
2
1
6
13
MAX RATE
LOW $V_C$
SLOWER
STOPPED
SLOW
F

VAPOROUS GASOLINE FUEL SYSTEM AND CONTROL THEREFOR

This invention relates to a new and novel fuel system and more particularly to a fuel system especially designed for use with internal combustion engines or the like, and which fuel system is operable therewith to provide fuel fumes to the engine from a source of liquid ignitable vaporizable fuel, such as gasoline, and of sufficient quantity, whereby to significantly increase the efficiency of the engine, to thus substantially increase the per gallon mileage rate for the engine when used in an automotive vehicle or the like, and using the liquid fuel as an original fuel source. This fuel system is provided with an electronic monitoring and control system especially operable to monitor the combustion of the vaporized fuel and air delivered to the engine and which is responsive to a change in the engine demand for said fuel to maintain the optimum ratio of fuel and air in said vaporized fuel mixture delivered to the engine for combustion.

BACKGROUND OF THE INVENTION

It is recognized in the art that the efficiency of the typical internal combustion engine in present use in automotive vehicles and the like is approximately twenty-five percent or less when using liquid fuel such as gasoline or other like ignitable fuels, such as for instance pentane, hexane, heptane, octane, nonane, decane, undecane, dodecane, tetra decane, hexadecane, octadecane and crude oil.

Typical prior art fuel systems are exemplified in U.S. Pat. Nos. 983,646; 1,470,204; 3,338,223; 3,749,376; 3,854,463; 4,204,485; 4,200,064; 3,790,139; 3,999,526; 4,074,666; 4,076,002 and 4,177,779.

In the use of any such liquid fuel with an associated internal combustion engine it is well recognized that a substantial percentage of said fuel is not utilized by the engine for power generation, but instead is expelled from the engine and/or burned or consumed in the exhaust system thereof.

In applicant Kenneth A. Jackson's pending U.S. patent applications Ser. Nos. 86,323, filed Oct. 19, 1979 and 129,345, filed Mar. 11, 1980, and in applicants Kenneth A. Jackson and George I. Arndt's copending application Ser. No. 151,170, filed May 19, 1980, there is disclosed a novel fuel system which will materially increase the efficiency of an internal combustion engine, and the prior art identified therein is incorporated herein, without specifically listing the same. The present invention is an improvement of a system of the general type disclosed in Ser. No. 151,170.

BRIEF DESCRIPTION OF THE INVENTION

Briefly, the invention provides a fuel system for use with an internal combustion engine or the like wherein fuel fumes are generated from a liquid source of ignitable fuel such as gasoline, or similar liquid vaporizable fuel, and presented in a fumed state to the engine for consumption and power conversion therein, and wherein the system is provided with improved means for fuming the liquid fuel.

Novel arrangements of fume tanks are disclosed for use in the fuel system.

Substantially all of the fumed fuel presented to the engine is consumed therein for power conversion, thus resulting in substantially increasing the efficiency of the engine and hence substantially increasing the mileage rate per gallon of liquid fuel.

In actual testing of one embodiment of system incorporating the present invention with an internal combustion engine in an automobile, the mileage rate obtained per gallon with liquid leaded gasoline as the source of ignitable fuel, has been of the order of at least 400 percent greater than that which has been heretofore obtainable using liquid gasoline which is directly burnable in the engine.

For example, testing of the present system has been undertaken with a 1975 Cadillac wherein the mileage rate per U.S. gallon of fuel obtained has been in the magnitude of 45–48 miles per gallon with liquid leaded gasoline as the fuel source.

It is, therefore, a primary object of the present invention to provide a fuel system especially designed for use with an internal combustion engine utilizing liquid ignitable fuel as the fuel source, and wherein the fuel system is operable to generate fuel fumes from said liquid fuel and to provide a sufficient quantity of the same to the engine, so as to substantially increase the operating efficiency of the engine.

Another object of the invention is to provide a fuel system especially designed for use with an internal combustion engine of an automotive vehicle adapted to utilize liquid ignitable fuel and which system is operable to generate fuel fumes in an improved manner from the liquid fuel, and to provide fumes of sufficient quantity to the engine, whereby to significantly increase the efficiency of the engine, to thus substantially increase the automotive vehicle per gallon mileage rate of the liquid fuel.

Another object of the present invention is to provide an electronic control for use with the fuel system and which is operable to monitor the combustion of the vaporized fuel by the engine and which control is responsive to a change in engine demand to maintain the optimum ratio of the mixture of vaporized fuel and air delivered to the engine.

Still another object of the present invention is to provide a fuel system as hereinabove referred to which is operable at atmospheric pressure and which utilizes the vacuum or suction generated by the engine, to provide the fuel fumes to the engine.

Other objects and advantages of the invention will be apparent upon reference to the following description taken in conjunction with the accompanying drawings, which illustrate preferred embodiments thereof.

BRIEF DESCRIPTION OF PREFERRED EMBODIMENT

The fuel system of this invention provides fumed fuel from a source of liquid fuel such as gasoline or like liquid ignitable fuel, many of which are hereinabove referred to, to an internal combustion engine.

As one preferred embodiment, it is herein described, for use with an automobile wherein "fumed gasoline fuel" is generated in an auxiliary or fume tank, which coacts with a main liquid fuel tank, and is mixed with air, and then supplied to the carburetor of the engine, for powering the latter. The fume tank is controllably vented or connected to atmosphere, to provide suitable quantities of air for fuming and mixing with the vaporous fuel, and improved means are provided for accomplishing the fuming of the liquid fuel. The present system incorporates an control which is operable to monitor the exhaust gases which result from the combustion of the vaporized fuel and air mixture delivered to the engine and which control is responsive to a change in engine demand as sensed in said gases to correspondingly modify the air delivered to said mixture being thus operable to maintain the optimum ratio of the vaporized fuel and air in said mixture.

BRIEF DESCRIPTION OF THE DRAWINGS

FIG. 2 is a view taken generally along the plane of line 2—2 of FIG. 1 and illustrates in section the rear trunk area of the automobiles and the main gasoline tank located therebelow, with the auxiliary or fume tank projecting upwardly from the main tank and extending into the trunk space;

FIG. 3 is a view looking along the plane of line 3—3 of FIG. 1 showing a partially broken, enlarged plan view of the carburetor and associated air cleaner housing, and of connections thereto, as embodied in the fuel system of the present invention;

FIG. 4 is a generally diagrammatic elevational view of the fuel system of the invention connecting the carburetor of the vehicle engine with the source of liquid fuel;

FIG. 5 is an enlarged, sectional view taken generally along the plane of line 5—5 of FIG. 2, looking in the direction of the arrows, and illustrating the underside of the diffuser mechanism in the auxiliary or fume tank of the system.

FIG. 10 is an enlarged view of an auxiliary or fume tank generally similar to that of FIG. 6, but illustrating a further embodiment of fume tank which includes means for further aiding in vaporizing the liquid fuel and in removing droplets of liquid fuel from the fumed air-fuel mixture prior to its passing from the fume tank;

FIG. 11 is a schematic diagram of the electronic control incorporated for use with the present fuel system;

FIG. 12 is a schematic diagram illustrating the control circuitry of the control of FIG. 11; and FIG. 13 (A–F) is a chart illustrating electrical signal waveforms which are present at various locations in the electronic control.

DESCRIPTION OF PREFERRED EMBODIMENTS

While the fuel systems illustrated are particularly adapted for use with an internal combustion engine in an automotive vehicle type of environment, it is also contemplated that said system may be adaptable to an internal combustion engine in varied environments such as tractors, stationary power units, off-the-road equipment, and the like.

Figure 1:
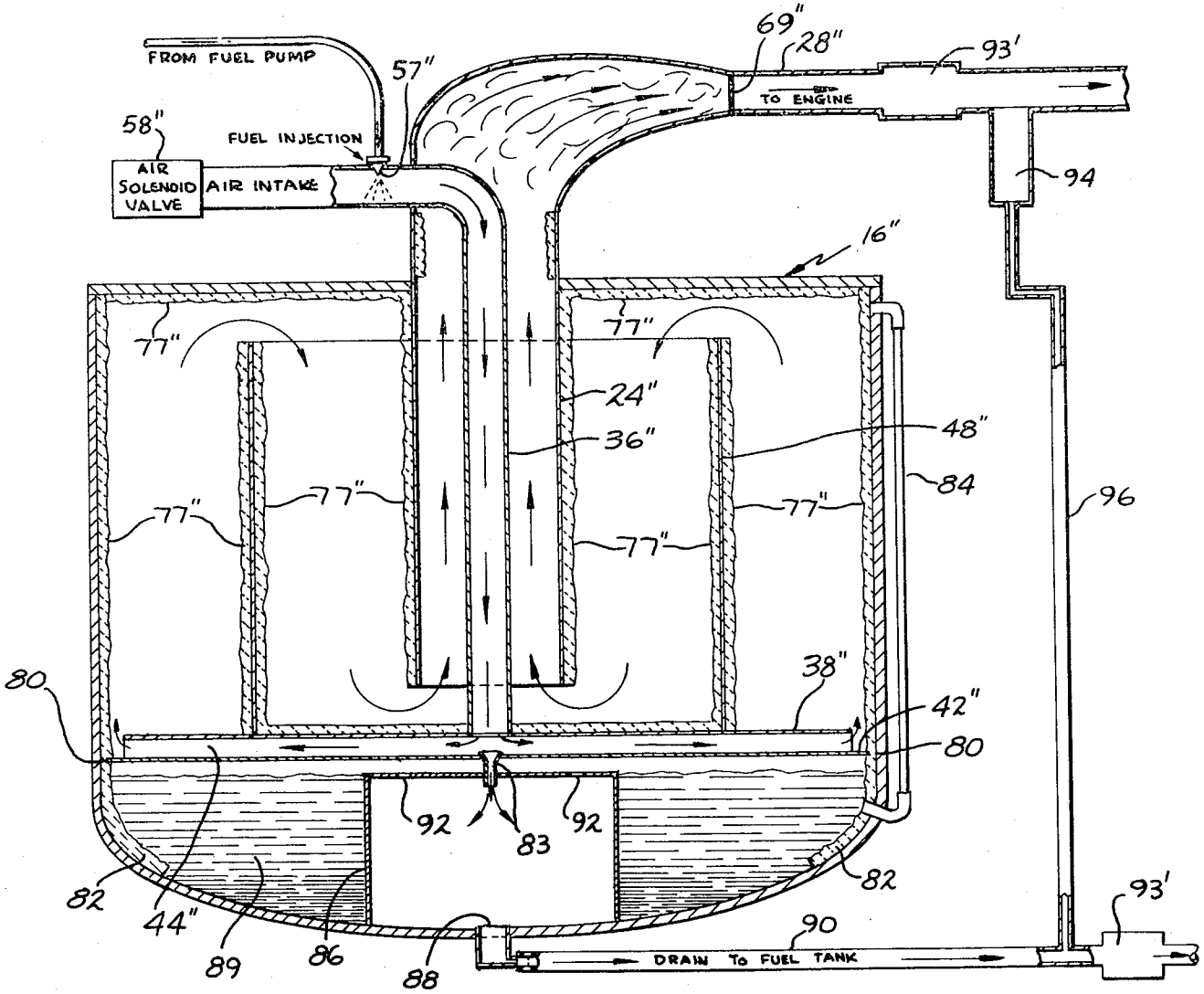
FIG. 1 is a perspective view illustrating a typical automobile in phantom, with the fuel system of the present invention interconnected between the tank containing the liquid fuel and the carburetor of the engine.

As herein illustrated, and as also disclosed in applicants' copending application Ser. No. 151,170, filed May 19, 1980, a typical automobile vehicle V is shown in FIG. 1 equipped with an internal combustion engine 10 designed to burn liquid ignitable fuel supplied by a more or less conventional fuel tank (e.g. tank 12 having liquid fuel inlet 12*a* and conventional vented cap 12*b*) for providing liquid fuel such as gasoline or any other liquid vaporizable ignitable fuel, to the carburetor 13 of said engine.

As aforementioned, with the fuel such as gasoline being supplied to the engine 10 in its liquid state, the engine only uses about 25–30 percent of said fuel for power conversion whereby the major part of said fuel is wasted and emitted in various well known pollutant forms from said engine.

As aforementioned, the fuel system of the present invention overcomes this deficiency by providing ignitable fuel in its "fumed state" such that substantially all of the delivered fuel to said engine is utilized for power conversion.

To accomplish this, a fuel fume tank or auxiliary tank identified at 16 which is generally cylindrical in its present configuration, coacts in the upright position with the conventional fuel tank 12 located below the trunk space 18 (FIG. 2) of the vehicle, and with its (member 16) lower end projecting into the interior of tank 12, so as to be disposed in submerged relation with the anticipated level 19 of liquid fuel in main tank 12. Tank 16 in the embodiment illustrated comprises top wall 20, side wall portion 20*a* and bottom wall 20*b*, with such bottom wall, in the embodiment illustrated having a plurality of openings 22 therein, thus communicating the interior of tank 16 with the interior of main tank 12, and thus establishing the liquid fuel level in tank 16 at substantially the same level as that of the liquid fuel in main tank 12. Tank 16 is received in the complementary opening 23 formed in the top wall of main tank 12 in sealed relation, either by adequate gasketing means or by permanent welds securing tank 16 to tank 12.

In its present configuration, tank 16 is about 16" in its external diameter, to define a fume chamber 16*a* therein.

One end of a collector member or tube 24 is secured as at 24*a* by any suitable means, such as, for instance, welds, to the top wall 20 (in the embodiment illustrated) of the auxiliary or fuming tank 16, with such member 24 projecting interiorly of the fuming tank 16, and being open at its bottommost end, for passage of fumed fuel-air mixture thereinto from the fuming tank.

Member 24, in the embodiment illustrated, is of arcuate configuration in side elevation, as can be best seen in FIG. 2, and at its distal end comprises a pair of branch conduit sections 26, 26*a*, which have coupling means 27 coacting therewith such as, for instance, threaded coupling means, for coupling member 24 to a respective line 28, 28*a*.

Line 28 is directed to the carburetor 13 passing through a tight fitting opening in the conventional air cleaner housing 30 mounted on the carburetor, and with line 28 terminating just above the conventional butterfly valve 32 located in the carburetor throat, thereby providing for passage of fumed fuel-air mixture from the collector member 24 to the carburetor. Line 28*a* passes from the collector 24 to coupling 34, mounted to the conventional air cleaner housing 30, thereby providing a further passage for the transmission of additional fumed fuel-air from the collector 24 to the carburetor.

Collector tube 24 in the specific embodiment illustrated, is preferably approximately three inches in internal diameter, while supply line 28 has an internal diameter of preferably approximately 1½", and line 28*a*, has a corresponding diameter of approximately ¾". Such lines 28, 28*a* are capable of providing sufficient fumes to carburetor 13 for powering the engine.

Extending from exteriorly of collector member 24 and passing through the wall thereof in sealed relationship, is an air inlet conduit 36, which extends downwardly through the downwardly extending collector pipe 24 below open end thereof, with pipe 36 having a diffuser member 38 secured thereto just above the level 19 of liquid fuel in auxiliary or fuming tank 16.

Diffuser member 38, in the embodiment illustrated, comprises an upper plate 40 and a lower plate 42 (FIG. 5) with the distal end of air inlet pipe 36 being disposed in vertically spaced relation above the lower plate 42 so that as air (and also fuel as will be hereinafter described) passes downwardly through the pipe 36, it impinges against the upper surface of lower plate 42. Extending generally radially outwardly from the vertical axis of plate 42 commencing generally adjacent the periphery of lower plate 42, are a plurality of arcuate vanes 44 so that the air and fuel passing into diffusing member 38 is twirled or given a vortex effect as it streams outwardly through the diffusing member 38 and across the confronting surface of the liquid fuel in auxiliary tank 16, thus fuming the fuel and creating a relatively rich mixture of fuel and air, which is then drawn upwardly by the engine vacuum, as will be hereinafter discussed.

As the fumed fuel-air mixture is drawn upwardly in chamber 16*a* of fume tank 16, it passes through a baffle arrangement 48, which may be supported on aforementioned inlet pipe 36, such baffle comprising a cup-like member 48*a* which opens upwardly so that the fumed fuel-air vapor has to pass upwardly over the open top of the cup-shaped baffle and then downwardly to pass into the lower open mouth of collector member 24, and aiding in removal of only liquid droplets of fuel from the fumed fuel-air mixture.

Air inlet pipe 36 preferably has an interior diameter of approximately one inch. Branching off from air inlet pipe 36 and in communication therewith is a liquid fuel pipe or conduit 50 of conventional internal diameter size coming from the output port of the conventional fuel pump 52 (FIG. 4) of the conventional internal combustion engine 10. The input port of the fuel pump 52 is connected by means of conventional conduit line 54 (FIGS. 1 and 4) to the conventional outlet port 56 on the main fuel tank 12. Fuel lines 50 and 54 preferably have an internal diameter in the embodiment illustrated of approximately ⅜".

A shower head or liquid diffusing screen 57 of conventional known type may be provided either at the connection of fuel line 50 to air inlet line 36, or in the alternative at the distal end of air inlet line 36, so that the liquid fuel as it is mixed with the air being inserted into the diffuser member 38 via line 36, is broken into a fine mist, thus facilitating the fuming of the liquid fuel and enriching the fuel-air mixture with fumes of the liquid fuel as compared with liquid fuel droplets. The impacting of the lower plate 42 in diffuser 38, by the fuel-air mixture emanating from the distal end of inlet line 36 likewise aids in the removal of liquid droplets from the fuel-air mixture.

A conventional, normally closed, air check valve 58 (FIGS. 2 and 4) coacts with the air inlet line 36 and is intended to be actuated to its open condition in response to the pressure in the fuming tank 16 reaching a negative pressure (vacuum) of approximately minus one pound of mercury as read on a conventional automotive vacuum gage, thus connecting the interior of the fuming tank 16 through the air inlet pipe 36 to atmosphere. In actual practice this magnitude of negative pressure (vacuum) is substantially immediately realized upon the engine 10 being initially actuated or "turned over" as is referred to in the art.

Referring now to FIG. 3, the circular wall of the air filter housing member 30 is provided with two air entry ports 60 and 62 respectively. The conventional air intake chute 64 on the air cleaner is blocked, as at 65, so that air cannot be drawn thereinto as is conventionally done with an internal combustion engine. Port 60 is connected to a normally closed conventional air check valve 66, while port 62 is coupled to a normally closed conventional air check valve 68. Valve 66 is adapted to open in response to pressure in the throat of the carburetor reaching a negative pressure (vacuum) of approximately one and one-half pounds of mercury, thus coupling the closed air cleaner housing to the exterior air shortly after the engine is "turned over" or actuated, thus permitting air to pass through the valve 66 and "leaning out" the fuel-air mixture of fumed fuel being supplied via lines 28, 28*a* to the carburetor. In the present system, as will be hereinafter described, the air check valve 68 is positively controlled by the electronic control of the instant system to variably regulate the amount of air entering the carburetor for mixing with the fuel-air mixture, thus furnishing further outside or atmospheric air to the carburetor. If needed, one or more additional air check valves (not shown) may be used in the manner air check valve 68 is incorporated in the fuel system of the aforementioned co-pending application Ser. No. 151,170 which valve 68 is coupled to carburetor port 62 and adapted to open when the pressure in the carburetor throat reaches a negative pressure (vacuum) of approximately five pounds of mercury to admit additional air into the carburetor.

In operation the fume fuel system of the FIGS. 1 through 5 system is preferably as follows.

Assuming that the engine 10 is off, or at rest condition, a certain quantity of fuel fumes is being generated in the fuming tank 16 due strictly to the fact that there is liquid fuel therein. In this rest condition, the air check valves 58, 66 and 68 are in closed condition, and the butterfly valve 32 in the carburetor throat is likewise in generally closed position.

When the engine is turned over either manually, or by the typical battery-powered starter used in conventional present-day automotive systems, the initial cranking of the engine will generate a vacuum in the fuming tank 16 and in the air inlet pipe 36 as well as in the engine manifold, and in carburetor 13, when the butterfly valve 32 is opened through the conventional foot control accelerator or throttle (not shown), or by any other means, thus causing the vacuum to go to about minus one pound of mercury in the carburetor as well as in the lines 28, 28*a* and in the aforementioned fuming tank 16 and air inlet 36, and thus resulting in the air check valve 58 to outside air, permitting air from atmosphere to flow into inlet pipe 36. At the same time, the cranking of the engine causes the fuel pump 52 to pump liquid fuel via fuel line 50 into air inlet pipe 36 through the misting connection 57, thereof, thereby supplying a combined fuel-air mixture to the diffuser member 38, whereupon the fuel mixture whirls in cyclonic fashion outwardly from the center of the lower baffle, or abutment plate 42, to pass across the surface of the liquid fuel in auxiliary tank 16 upwardly past the baffle arrangement 48, and into the open bottom end of the collector tube 24.

The cyclonic, or whirling effect of the diffuser 38 aids in elimination of liquid droplets from the fuel-air mixture abutting against the abutment plate 42, thereby maintaining the fuel-air mixture being supplied to the engine in vaporous condition, as well as enhancing the vaporization of the liquid fuel. Such fuel-air mixture, passing upwardly through the baffle 48, likewise aids in removal of any liquid droplets in the fuel-air mixture to further aid in increasing the efficiency of the engine.

From collector chamber 24, the fuel may pass through the fuel supply lines 28, 28*a* to the carburetor, whereupon the fuel in the piston firing chambers of the engine 10 is ignited, to cause the engine to fire. As the comparatively rich fuel-air vaporous mixture is passed into the carburetor, due to the vacuum caused by cranking the engine, the atmospheric air inlet check valve 66 opens to mix further at approximately a minus one and one-half pounds of mercury, to "lean" out the fuel as it passes through the throat of the carburetor to the piston chambers.

Upon firing of the engine, the atmospheric air check valve 68 under control of the electronic control of FIGS. 11–13 is initially opened thereby to a "preset open position" as will be later more fully explained to further lean out the comparatively rich vapor being furnished to the carburetor via lines 28, 28*a*, and the engine is then available to power the vehicle V. The electronic control senses the exhaust gases by its EGO sensor and variably regulates the air check valve 68 upon a change occurring in the engine load to thereby correspondingly vary the amount of air passing therethrough and with the carburetor thus maintaining an optimum ratio of vapor fuel and air in the fuel-air mixture under varying engine load conditions. Safety screening, such as for instance miner's screen, are preferably provided as at 69 in collection chamber 24 and in supply lines 28, 28*a* at their connections to the air filter housing 30, to extinguish any flame in the event of back firing of the engine.

It will be seen that the system of FIGS. 1 through 5 is a closed system, with outside atmospheric air being admitted to the system only upon opening of the air check valves 58 and 68 which occurs upon cranking of the engine. When the engine is shut off by turning off the key thereto, the air check valves 58, 66 and 68 close, and the butterfly valve 32 is returned to its closed position, thus causing the pressure in the carburetor to return to approximately zero magnitude, thus stopping any ingress of atmospheric air into the system. It will be understood that in the present system wherein only a fumed fuel and air mixture is provided to the engine for combustion, substantially all of the fuel-air mixture is burned for power conversion, thus resulting in substantially increasing the efficiency of the engine, and for automotive type vehicles, such system is operable to substantially increase the vehicle mileage rate per gallon of liquid fuel that is utilized in the fuel tank.

Figure 6:
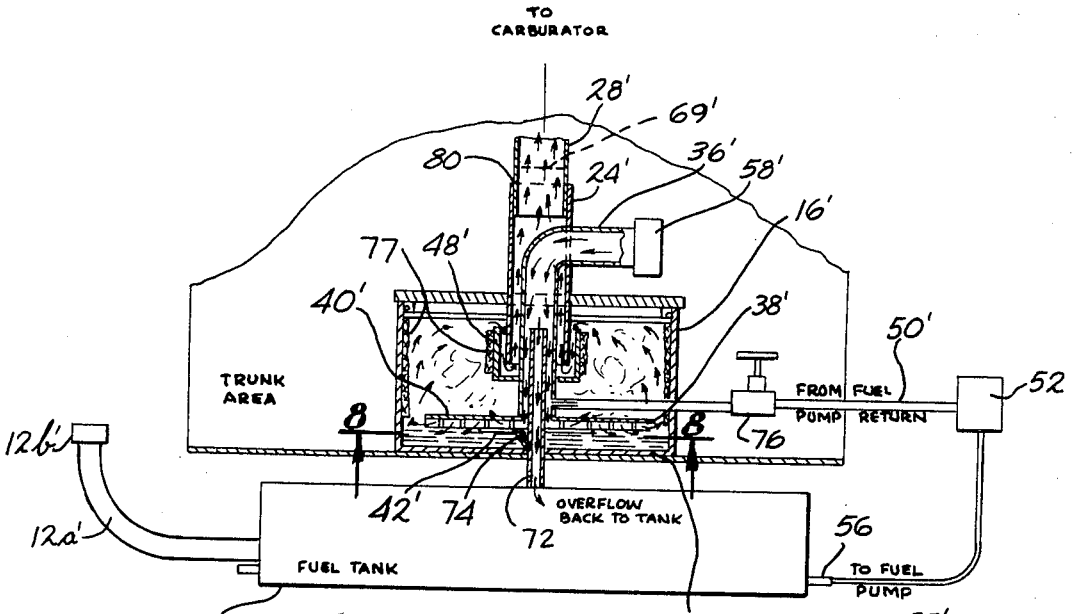
FIG. 6 is a sectional view generally similar to FIG. 2, but illustrating another embodiment of system especially as concerns the auxiliary or fume tank and associated main liquid fuel tank.
Figure 7:
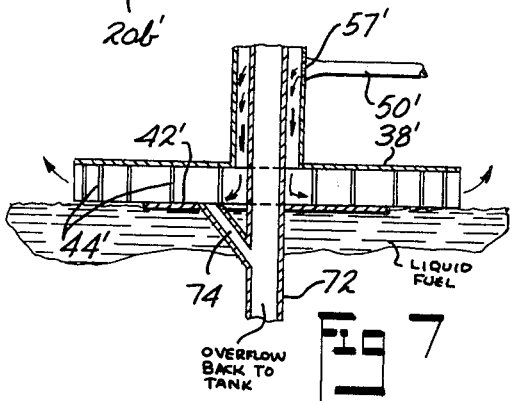
FIG. 7 is an enlarged detail view of the auxiliary tank of FIG. 6 illustrating an overflow arrangement.
Figure 8:
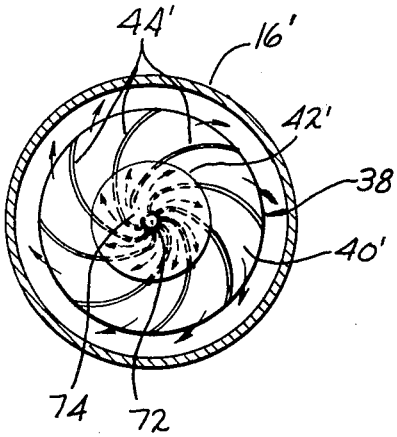
FIG. 8 is a view generally similar to FIG. 5, but taken along the plane of line 8—8 of FIG. 6.

Referring now to FIGS. 6 through 7, there is shown another embodiment of fuming tank arrangement. In this embodiment, the fuming tank is more readily connectable to an existing main fuel tank without substantial alteration of the latter and an overflow arrangement is provided for causing fuel inserted into the air inlet line to be returned to the main tank when it gets to a predetermined level in the auxiliary fuming tank. In this arrangement, like reference numbers have been utilized when referring to the component parts thereof, except that the prefix prime (') has been added thereto.

In this arrangement, the auxiliary fuming tank 16' includes a non-perforated bottom wall 20*b'*, but which has a pipe or conduit member 72 extending through such bottom wall 20*b'* in sealed relation therewith, and which extends downwardly to communicate at its lower end with the interior of the main fuel tank 12' of the vehicle. Coacting with upright pipe 72 is an overflow pipe section 74 which branches off from pipe 72 and extends a predetermined distance above the bottom surface of the auxiliary tank 16' and in this embodiment opens onto the upper surface of bottom baffle plate 42 of diffuser member 38'. Thus it will be seen that in the event that the fuel level in auxiliary tank 16' gets up to the entry mouth pipe 74, the fuel flows down through branch pipe 74, through pipe 72 to the interior of main fuel tank 12'.

The air inlet pipe 36' in this embodiment extends from exteriorly of the collector pipe or member 24' through the wall thereof in sealed relationship and extends downwardly to terminate at the upper plate member 40' of diffuser member 38'. In other respects, the diffuser member 38' is generally similar to that aforediscussed in connection with diffuser member 38 of the first described embodiment. The air inlet pipe 36' has a conventional air check valve 58' coacting therewith in a similar manner as the corresponding air check valve in the first described embodiment. In this embodiment, the fuel line 50' from the fuel pump 52 preferably has a manually actuatable shut-off valve 78 therein, and with such fuel line extending into the air inlet pipe 36' just above the diffuser member 38', a liquid misting screen or head 57' is preferably utilized at the entry end of line 50' into air inlet line 36' and in a generally similar manner as in the first described embodiment.

In this embodiment, the collector member 24' coacts with a single transmission line 28', in the embodiment as illustrated. Line 28' is preferably approximately two inches in internal diameter and connected to collector 24' in sealed relationship and as at 80. Line 28' is then coupled to the carburetor preferably in a generally similar manner as the coupling of line 28 in the first described embodiment. This single transmission line 28' takes the place of the two substantially smaller lines 28, 28*a* in the first described embodiment.

In this embodiment of fuming tank 16', the interior of the side walls thereof may be covered with a liquid absorbent material, such as at 77, impervious to the action of the fuel, for aiding in removal of liquid droplets from the fumed air-fuel mixture being dispersed from the diffuser member 38' to the interior of the fuming tank 16' prior to its passage through the baffle member 48' and entry thereof into the collection member 24'. A suitable material for such droplet absorbing member has been found to be non-woven fabric in the form of carpeting of polyester, or nylon, or the like.

Referring now to FIG. 10, there is shown a further embodiment of auxiliary or fume tank which is somewhat similar to the fume tank embodiments illustrated in the previous embodiments of FIG. 2 and FIG. 6 respectively, but which includes thereon on the interior of the tank a greater amount of the liquid absorbent material 77" shown in FIG. 6 embodiment. Moreover, in this embodiment, the diffuser member 38" is somewhat different from the diffuser members of the first described embodiments, and a different arrangement is provided for passing of the overflow of liquid fuel in the fume tank back to the main fuel tank. Like numbers have been utilized to designate generally similar parts except that the prefix " has been added thereto.

As can be seen from FIG. 10, the bottom plate 42" of the diffuser assembly 38" is the larger of the plates, with the top plate 40" providing the bottom of the cup baffle 48". The vanes 44" commence adjacent to the axial center of the plates 40", 42" and are arcuate in a generally similar manner as in the first described embodiments, for causing a whirling of the inlet fuel and air mixture as it strikes the bottom plate when it emerges from the distal end of the inlet pipe 36".

Bottom plate 42" extends almost completely across the dimension of the fuming tank 16" and terminates just short of the side walls thereof and as at 80. The top plate 40" of the diffuser 38" preferably terminates just short of (approximately ½ inch) of the fabric covered side walls of tank 16".

The aforementioned fabric material 77" covers not only the interior surfaces of the side walls of the fuming tank, but also the interior surfaces of the top wall as well as the side and interior bottom surfaces of the baffle member 48" and also the exterior of the collector member 24" where it extends into the fuming tank 16". Accordingly, the fuel-air mixture passing through the diffuser up over the baffle member 48" and then downwardly into the cup-like baffle to enter the lower open end of the collector 24" is passed by or exposed to a substantial amount of the fabric 77", thus removing substantially all of any liquid droplets in the fuel-air mixture to maintain maximum efficiency for powering the engine. It will be seen that the lower end of the fabric material on the side walls of the fuming tank extend downwardly as at 82, below the lower plate 42" of the diffuser 38" and into the pool of liquid fuel which ordinarily is found therein. Liquid fuel by the "wicking" action of the fabric is drawn upwardly into the fabric covering the side walls and the top wall, wetting the latter with liquid fuel, and thus aids in fuming the fuel-air mixture. A funnel member 83 is provided through plate 42" in general alignment with inlet pipe 36" so that some fuel-air mixture from pipe 36" passes through lower plate 42".

A sight tube 84 may be provided on the exterior of the fuming tank for indicating the level of liquid fuel therein.

A housing member 86 is provided over the drain port 88, which is connected as by means of a drain line 90 to the main fuel tank (not shown), and if the level of liquid in chamber 89 gets above the level illustrated, it will overflow housing 86 and then flow down through openings 92 in enclosure 86 and out the drain 88 to the main fuel tank. Expansion chamber 93 may be provided in line 90.

The upper end of the collector member 24" is reduced from the approximately three inch diameter of the vertical portion thereof down to approximately one and seven-eighths inch diameter where it is connected to the feed line 28", which is directed to the carburetor. As can be seen, an expansion chamber 93' may be provided in line 28", and also a drain 94 may be provided in line 28" and connected by line 96 back to line 90 to the main fuel tank, for further removal of any liquid fuel that may still exist in the fuel-air mixture being fed to the carburetor by the vacuum pressure.

Line 28" is preferably approximately one and one-half inches in internal diameter. Operation of this embodiment of fuming tank is generally similar as that described for the previous embodiments, except that due to the coating material, or fabric 77", the fuel-air mixture is further enriched with vapor emitted from coating 77", and thus is maintained in an even greater magnitude of vaporous condition.

Figure 9:
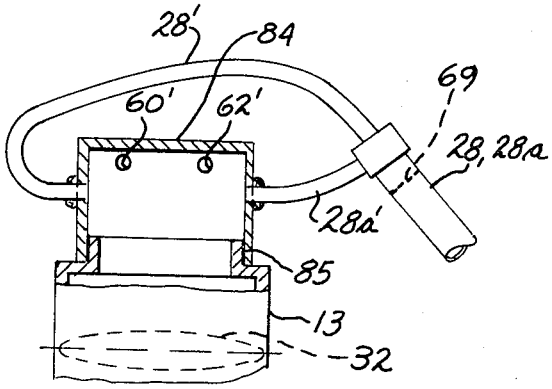
FIG. 9 is a vertical, sectional enlarged view of another embodiment illustrating a cap rather than an air filter housing, for use with a conventional internal combustion engine carburetor, for controlling the air intake of the carburetor during the supplying of fumed fuel thereto from an auxiliary or fume tank system of the type of FIG. 2 or of the type of FIG. 6.

Referring now to FIG. 9 there is shown a modified arrangement of closed carburetor head for replacement of the first described conventional air cleaner housing on the carburetor. In this embodiment the closed head member 80 is mounted in generally sealed relationship on the conventional throat 85 of the carburetor 13. The air ports 60', 62' are provided in the head member 84, above the entry of the fuel-air mixture transmission lines 28', 28a' to the carburetor throat, so that the atmospheric air being admitted from the atmosphere to the carburetor throat via the air check valves (not shown) associated with the respective part is admitted above the discharge end of the fuel-air mixture transmission lines 28', 28' to the head. Thus the atmospheric air being applied to the carburetor to lean out the mixture of fuel-air being furnished to the carburetor by lines 28', 28' is entered into the carburetor head above the enriched fuel-air mixture being supplied from the fuming tank. Such a closed carburetor head arrangement will provide slightly greater vacuum to the carburetor upon turning the engine over than say, for instance, the vacuum when utilizing the air cleaner housing member 30 of the FIGS. 3 and 4 embodiment.

In FIGS. 11–13 there is shown the electronic control that is operable with the present fuel system as previously disclosed and illustrated in FIGS. 1–10, and which control is operable to monitor and variably regulate the fuel-air mixture being delivered to the engine so as to maintain the optimum ratio of fuel and air in said mixture under varying engine load conditions.

As seen in FIGS. 11 and 12, the control uses a sensor element 100 of conventional design such as the (EGO) Oxygen Sensor No. ES-D9EE-9F472-AB manufactured by Ford Motor Company hereafter also called EGO sensor which is conventionally located in the exhaust gaseous stream of the engine and therein capable of detecting the presence or absence of free oxygen in the exhaust gases. As will be understood in the art, the EGO sensor 100 is operable to emit a voltage signal that is indicative of the amount of free or uncombined oxygen in the exhaust gases and which signal is hence demonstrative of the fuel-air mixture being delivered to the engine. For example, if free oxygen is present in the exhaust gases it is an indication that too much air was in the fuel-air mixture input to the engine, and conversely if there is no free oxygen in the exhaust gases it is an indication of either that the fuel-air mixture was at its optimum wherein all oxygen is consumed or that insufficient air was present in the inlet fuel-air mixture which would then leave a certain trace of unburned fuel in the exhaust gases.

In the present control the operating level or point of the EGO sensor is preferably selected so that the "optimum" fuel-air mixture tends to be "lean" or approximately 1 part fuel to 15 parts air by weight to thus cause some free oxygen to be present in the exhaust gases but not of such quantity as to generate an intolerable level of nitrous oxide (NO). In the EGO sensor hereinabove identified this selected operating level usually provides an output voltage signal of above 50 millivolts.

As seen in FIG. 11, the configuration of the electronic control disclosed herein is a "closed loop" system wherein a change in the load condition of the engine, as for example when the accelerator is depressed to increase engine speed, causes the sensor signal S1 to correspondingly change and which signal is then fed to the input of the control and effective to correspondingly adjust the fuel-air mixture to the engine. As the fuel-air mixture is adjusted to accommodate the changed load condition of the engine, the corresponding engine response and resultant exhaust gases indicates the return to "optimum condition" and the sensor signal S1 thus returns to its "optimum signal level" depicted at 1 or 20 in FIG. 13B.

As seen in FIGS. 11 and 12, the voltage signal S1 of sensor 100 is connected to the input of controller 112, the schematic configuration of which is illustrated in FIG. 12.

The function of the controller is to compare the EGO sensor output with a reference signal to determine whether corrections in the fuel-air mixture are necessary. It also determines which way to correct the mixture, and the rate at which to correct. If the sensor and reference signals are nearly equal, the rate of correction is relatively slow whereas if said signals differ to a greater degree the rate of correction is correspondingly relatively fast.

For this purpose the controller 112 may be of conventional design having, in its present configuration, a signal conditioner circuit 114 which may have one or more amplification stages connected in circuit with suitable dampener and shaper circuits effective to eliminate any signal transients and to amplify the sensor output signal to a signal level of approximately ten times the input signal level.

The signal output of the controller 112 tracks the waveform generated by the EGO sensor and is pictorially illustrated as signal S2 in FIG. 13.

This signal S2 is then applied to a voltage controlled oscillator 116 of the controller 112 which, in its present configuration, comprises a control circuit 117 which may include one or more suitable differential amplifier circuits capable of receiving the signal S2 and comparing it with high and low voltage signal limits which may be adjustable to produce the output signal waveform as depicted at S4 in FIG. 13.

Referring to the signal waveform S4 in FIG. 13, it is seen to be somewhat trapezoidal in configuration having the lower voltage limit $V_L$ selected as 1.0 volt and the upper voltage limit $V_H$ as 5.0 volts and a constant magnitude of 8.0 volts between the limits of 2.0 volts and 4.0 volts. As will be hereinafter discussed in greater detail, the leading edge of signal S4 is identified as "low slope" and is intended to enable variable rate adjustments to be made to the air of the fuel-air mixture during a relatively lean condition whereas the trailing edge of said signal S4 identified as "high slope" is intended to enable variable rate adjustments of said air to the fuel-air mixture during a relatively rich condition.

The signal S2 is also applied to a direction control circuit 118 of the controller 112 which compares signal S2 with a fixed voltage reference signal $V_R$ to provide output signal S3 as depicted in FIG. 13 which is utilized, as will be hereinafter described in greater detail, to also provide for the adjustment of air to the fuel-air mixture to the engine.

The output signal S4 of the control circuit 117 is connected to the input of a voltage controlled oscillator 121 of conventional design which produces a pulsed output train or signal as seen at S5 in FIG. 13, the frequency or pulses of which is dependent upon the magnitude of the signal S4. The slower the magnitude of the input signal S4 the greater the frequency of the oscillator output S5 and vice versa.

The pulse output signal S5 and the output signal S3 from direction control circuit 118 are connected to the input of a motor drive unit 128, which in its present configuration is a digital linear actuator, Series 92100 as manufactured by the North American Phillips Controls Corporation of Cheshire, Conn., and which comprises, as schematically shown in FIG. 12, a motor sequencer and drive unit 130 and a linear stepper motor 132.

As aforementioned, the present sensor system is operable to monitor the exhaust gases of the engine and to then correspondingly adjust the air component of the fuel-air mixture being delivered to the engine so as to maintain the optimum mixture for varying engine load conditions.

To accomplish this, the stepper motor 132 has a linearly movable shaft 133 as schematically shown in FIG. 11 which is connected to the movable actuator of one or more of the air check valves located at the carburetor on the engine. For purposes of this disclosure and without limitation as to the concepts herein, the shaft 133 of the stepper motor 132 is connected by coupling **133*a* to the actuator 134 of the air check valve 68, which valve is intended to be movably operable by said stepper motor to variably regulate the quantity of air passing therethrough and into the carburetor 13**.

The electronic control is connectable to the fuel system so that the EGO sensor 100 is located in the exhaust gas stream and capable of sensing the same when the engine is running. The output of said sensor system, i.e. the shaft 133 of the stepping motor 132 is connected to the air check valve 68 as aforesaid. With the engine running at idle or slightly thereabove, and with the sensor system responding to the fuel-air mixture so as to provide a signal to the stepper motor 132 whereby the air check valve 68 is actuated thereby to a partially open condition, permitting air to mix with said fuel-air mixture the connection between the stepper shaft 133 and the air check valve 68 is initially adjusted to regulate the air flowing therethrough until the ratio of fuel to air in said fuel-air mixture is "optimum" at said engine idle condition.

With this initial adjustment, it is thereafter anticipated that the sensor system will be responsive to any running condition of the engine to correspondingly variably regulate the air flowing through the air check valve 68 for mixing with the fuel-air mixture being thus operable to provide an "optimum" fuel-air mixture under all conditions of engine operation.

Assuming that the vehicle is moving and the engine is running at some cruising speed, the output signal of the EGO sensor 100 at said condition is illustrated at 1 in FIG. 13B. If the operator desires greater vehicle speed the accelerator pedal or throttle may be depressed to an adjusted position, as for example "fully depressed" whereupon a greater volume of vapor fuel and air is immediately drawn into the engine from the fume tank such that the fuel-air mixture is instantaneously richer, i.e. there is an insufficient amount of air to mix with the increased volume of fuel in said mixture. The signal response of the EGO sensor that is indicative of this condition is depicted at 2 in FIG. 13B.

This signal condition (2) FIG. 13B, produces the signal response S3 depicted at 4 in FIG. 13C resulting in the signal S4, FIG. 13E being instantaneously greater than the high voltage limit $V_H$ so that the pulse output train of the voltage controlled occillator is at a maximum rate as for example as illustrated at 6 in FIG. 13F.

As a result, the stepper motor is actuated to rapidly open the air valve 68 to a correspondingly "more open" position to permit additional air to enter the carburetor 13 and mix with the fuel-air mixture prior to its being burned.

This introduction of additional air through valve 68 thus dilutes said fuel-air mixture bringing it back toward its optimum mixture composition. As this occurs, the signal response of the EGO sensor also indicates, as shown at 8 in FIG. 13B, the return of said mixture toward its optimum composition.

If the accelerator or throttle is maintained at its "adjusted position", the output signal S4, FIG. 13E progressively decreases in magnitude until it reaches, as illustrated in the present example in FIG. 13E, a magnitude of 4.0 volts. At this instant, the stepper motor stops and the air valve 68 is then maintained open in this open condition.

Because of the inertial response of the engine and the instant fuel system, the open condition of valve 68 may let in too much additional air whereby the fuel-air mixture becomes "lean" i.e. too much air for the fuel in the mixture. This "lean" condition is sensed by the EGO sensor and is depicted at 12 in FIG. 13B. This results in the stepper motor being energized in the opposite direction by a pulse train somewhat like that shown at 13 in FIG. 13F effective to slowly correspondingly close the air valve 68 whereby less air is permitted to pass therethrough. With less additional air, the fuel-air mixture thus returns to its "optimum composition". This "hunting" or cyclic actuation of the stepper motor may occur one or more times per each operator's adjustment to the throttle. In the present illustration, as is depicted in FIG. 13B only one such cyclic actuation is shown.

Once the fuel-air mixture returns to its optimum compositional value, this is sensed by the EGO sensor as is illustrated at 20 in FIG. 13B.

Thereafter, if a further adjustment to the throttle is made, as for example the operator releases the throttle to return the engine to its idle condition, less fuel is drawn into the engine thereby providing a "lean" fuel-air mixture which is sensed by the EGO sensor as is depicted at 24 in FIG. 13B.

This signal is then used to actuate the stepper motor so as to correspondingly adjust the air valve 68 sufficiently to reduce the air passing therethrough and thus return the fuel-air mixture to its optimum composition.

Hence, when any adjustment is made by the operator to the accelerator or throttle, a corresponding adjustment is automatically made by the present control to the air input to the fuel-air mixture so that it is retained in its "optimum composition" under varying engine loads.

From the foregoing discussion and accompanying drawings, it will be seen that the invention provides a novel fuel system for use with an internal combustion engine for generating a fumed fuel-air mixture and for supplying such mixture to associated fuel delivery means of the engine, for ignition therein and which system includes means for causing improved diffusion of the air and fuel, to improve the vaporization process and thus increase the efficiency of the fuel utilized in the engine. The invention also provides a novel fuel system embodying efficient fuming tank mechanism, which is operable to cause an increase of vaporization of the liquid fuel provided, together with means for more completely removing liquid droplets from the fumed fuel, to thus further increase the efficiency of the engine.

The present fuel system also incorporates therein a novel electronic control which is operable to monitor the engine combustion and to variably regulate the vapor fuel-air mixture to the engine such that said mixture is maintained at its "optimum mixture" for varying engine load conditions.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A fuel system for use with an internal combustion engine having associated fuel delivery means and fuel ignitable means for power conversion comprising, a containable source for liquid ignitable fuel, a collector means communicating with said source for collecting fuel fumes or vapor adapted to emanate from said liquid ignitable fuel, means communicable with atmosphere and extending into the container source being operable to transmit air into said source above the liquid fuel therein for generating a fumed fuel-air mixture therefrom, means for transmitting the fumed fuel-air mixture from said collector means to the associated fuel delivery means of the engine for ignition therein, means coacting with the means communicable with atmosphere and responsive to actuation of the engine for insertion of liquid ignitable fuel into said communicable means for intermixing with intake air therein, means coacting with said communicable means for diffusing the fuel-air mixture entering into said containable source above the liquid fuel therein, and electronic control means coacting with said engine and said fuel system being responsive to the operating load conditions of said engine to correspondingly control the fuel to air ratio of the mixture prior to the transmission of said mixture to said fuel delivery means of said engine effective to maintain said mixture at its optimum combustible composition.

2. A fuel system as defined in claim 1 and wherein the electronic control means includes at least one sensor means connectable to and operable to monitor the operation of said engine effective to provide a signal to said control and correspondingly adjust the fuel to air ratio of the fuel-air mixture delivered to said engine.

3. A fuel system as defined in claim 2 and wherein the sensor means is responsive to the amount of oxygen in the exhaust stream of the engine and operable to correspondingly adjust the fuel and/or air of the fuel-air mixture.

4. A fuel system as defined in claim 1 amd wherein valve means communicating with the fuel-air mixture is operable to provide air to said mixture, and said valve means being responsive to said control means to correspondingly vary the air to said mixture effective to maintain said mixture at its optimum combustible composition.

5. A fuel system as defined in claim 1 and wherein the collector means comprises tank means.

6. A fuel system as is defined in claim 5 and wherein the tank means and the fuel delivery means of the engine are adapted to be interconnected by the means for transmitting the fumed fuel-air mixture.

7. A fuel system as is defined in claim 6 and wherein the transmitting means comprises conduit means interconnected to the tank means and fuel delivery means of the engine.

8. A fuel system as is defined in claim 7 and wherein the conduit means connects the input of the fuel delivery means of the engine solely to the tank means.

9. A fuel system as is defined in claim 8 and wherein the engine is operable to provide a vacuum that is effective through the conduit means to draw the fumed fuel-air mixture to the fuel delivery means of the engine.

10. A fuel system as is defined in claim 9 and wherein the conduit means connects with the input of the fuel delivery means in a vapor seal relation effective to seal said input from atmosphere.

11. A fuel system as is defined in claim 1 and wherein the means for providing the liquid ignitable fuel to the collector means is a containable source.

12. A fuel system as is defined in claim 11 and wherein the containable source is the fuel tank normally provided with an automotive type vehicle.

13. A fuel system as is defined in claim 1 and wherein the control means comprises means for sensing the combustion of the fuel-air mixture delivered to said engine and which is responsive to the combustion of said mixture to provide a signal representative of said mixture, and means responsive to said signal to correspondingly vary the fumed fuel to air ratio of said mixture effective to maintain said mixture at its optimum combustible composition.

14. A fuel system as is defined in claim 2 and wherein the control means comprises means for sensing the combustion of the fuel-air mixture delivered to said engine being responsive thereto to provide a signal representative of said fuel-air mixture, and means operatively connecting said signal to the valve means being operable to correspondingly actuate said valve means and change the amount of air passing through said valve means being thus effective to maintain the fuel to air ratio of said mixture at its optimum combustible composition.

15. A fuel system as defined in claim 14 and wherein the means operatively connecting the signal to the valve means comprises motor means.

16. A fuel system as defined in claim 14 and wherein the control means is operable to normally position the valve means in a partially actuated condition effective to provide a preselected quantity of air to the fuel-air mixture.

17. A fuel system as defined in claim 16 and wherein the valve means is adjustable in response to the signal representative of the fuel-air mixture delivered to said engine to correspondingly modify the amount of air passing through said valve means being thus effective to maintain the fuel to air ratio of said mixture at its optimum combustible composition.

18. A fuel system as defined in claim 17 and wherein motor means operatively interconnected between the valve means and the signal is operable in response to the latter to adjust said valve means effective to correspondingly modify the amount of air passing therethrough.

* * * * *